US010139094B2

(12) United States Patent
Reichenbach et al.

(10) Patent No.: US 10,139,094 B2
(45) Date of Patent: Nov. 27, 2018

(54) DEVICE AND METHOD FOR ENCAPSULATING AND COOLING A SUBMERGED LUMINARY

(71) Applicants: Anibal Rene Reichenbach, Curitiba (BR); Rafael Reksidler Reichenbach, Sao Paulo (BR)

(72) Inventors: Anibal Rene Reichenbach, Curitiba (BR); Rafael Reksidler Reichenbach, Sao Paulo (BR)

( * ) Notice: Subject to any disclaimer, the term of this patent is extended or adjusted under 35 U.S.C. 154(b) by 0 days.

(21) Appl. No.: 15/709,070

(22) Filed: Sep. 19, 2017

(65) Prior Publication Data

US 2018/0080642 A1 Mar. 22, 2018

Related U.S. Application Data

(60) Provisional application No. 62/396,984, filed on Sep. 20, 2016.

(51) Int. Cl.

| | |
|---|---|
| ***F21V 29/57*** | (2015.01) |
| ***F21V 29/58*** | (2015.01) |
| ***F21V 3/00*** | (2015.01) |
| ***F21V 31/00*** | (2006.01) |
| ***F21V 29/77*** | (2015.01) |
| ***F21S 8/02*** | (2006.01) |
| *F21V 5/04* | (2006.01) |
| *F21Y 115/10* | (2016.01) |
| *F21V 17/12* | (2006.01) |
| *F21V 3/02* | (2006.01) |
| *F21W 131/401* | (2006.01) |

(52) U.S. Cl.

CPC ..... *F21V 29/58* (2015.01); *F21S 8/024* (2013.01); *F21V 3/00* (2013.01); *F21V 29/77* (2015.01); *F21V 31/005* (2013.01); *F21V 3/02* (2013.01); *F21V 5/04* (2013.01); *F21V 17/12* (2013.01); *F21W 2131/401* (2013.01); *F21Y 2115/10* (2016.08)

(58) Field of Classification Search

CPC ..... F21V 29/58; F21V 29/77; F21V 31/005; F21V 31/00; F21V 29/30; F21V 29/83; F21W 2131/401

See application file for complete search history.

(56) References Cited

U.S. PATENT DOCUMENTS 5,122,936 A * 6/1992 Guthrie ..... F21S 8/00 362/101

7,244,048 B2 * 7/2007 Poggi ..... F21S 8/00 362/267

(Continued)

*Primary Examiner* — Peggy Neils

(74) *Attorney, Agent, or Firm* — Greg M. Popowitz; Assouline & Berlowe, P.A

(57) ABSTRACT

A submerged light fixture including a light enclosure, a sealing agent, and an upper platform. The light enclosure includes a cover, lens, and lens ring that is secured to the upper platform. A series of radially position fins that define tunnels between the upper platform and a lower platform to provide a pathway for water to flow through the submerged light fixture and dissipate heat emitted from the light source in the light enclosure. A method of cooling a light source of a submerged light fixture, the light source being fully encapsulated with a sealing agent, by passing water underneath the light source through tunnels in the submerged light fixture defined by radially positioned fins.

19 Claims, 11 Drawing Sheets

(56) References Cited

U.S. PATENT DOCUMENTS

| | | | | |
|---|---|---|---|---|
| 7,553,040 | B2 * | 6/2009 | Boothe | F21S 8/00 362/101 |
| 8,783,910 | B2 * | 7/2014 | Hua | F21V 23/02 362/294 |
| 9,316,387 | B1 * | 4/2016 | Olsson | F21V 29/22 |
| 9,835,298 | B2 * | 12/2017 | Doyle | F21L 4/00 |
| 9,915,419 | B2 * | 3/2018 | Potucek | F21V 31/005 |
| 2007/0230194 | A1 * | 10/2007 | Julia Vilarrasa | F21V 23/005 362/373 |
| 2011/0267834 | A1 * | 11/2011 | Potucek | F21S 8/00 362/551 |

* cited by examiner

DEVICE AND METHOD FOR ENCAPSULATING AND COOLING A SUBMERGED LUMINARY

CROSS-REFERENCE TO RELATED APPLICATIONS

This patent application claims the benefit under 35 U.S.C. § 119(e) of U.S. Provisional Patent Application No. 62/396,984, filed Sep. 20, 2016, which application is incorporated herein by reference.

FIELD OF THE INVENTION

The invention broadly relates to a submerged light fixture, more specifically to an encapsulated LED submerged light fixture with a tunnel to dissipate heat, and even more particularly to the method of cooling a submerged light fixture using tunnels.

BACKGROUND OF THE INVENTION

Below ground swimming pools are common around the world. Many pools include light fixtures in the walls of the pool to illuminate the pool for varying purposes. In some cases, pool owners want to make the pool visible at night or other dark conditions for pool occupants. In other cases, the light fixtures are an aesthetic tool to create a unique pool experience, e.g. changing the light colors and timing.

Historically, incandescent bulbs were used in underwater light fixtures. However, the recent trend has shifted focus to light emitting diode (LED) light fixtures or luminaries. LED bulbs emit less heat from traditional incandescent or florescent bulbs. Light fixtures installed underwater for pools or other enclosed applications generate heat when they are powered on. The heat build up degrades the performance of the light fixture and causes the light fixture, or LED, to be replaced at a higher frequency. Given the submerged nature of pool light fixtures, this can be a costly and timely endeavor.

Although pools include water, it is difficult to use the pool water to transfer the heat generated by a luminary away from the luminary given the inherent conflict between water and electricity. State, federal, and international authorities have strict regulations on the interaction of water (or other conducting liquids) and electricity. With the submerged nature of light fixtures, absent use of the pool water on the exterior of the fixture lens, using the pool water to internally dissipate the heat generated from a LED or other light source has not been preferred.

The heat generated by the enclosed luminaries limits the power of the LED or similar light source. If the heat generated within the luminary enclosure was dissipated faster and more efficiently, the life of the LED could be increased and/or more powerful LED lights could be used.

As can be derived from the variety of devices and methods directed at enclosed light fixtures, many means have been contemplated to accomplish the desired end. Heretofore, tradeoffs between light fixture structure and heat generated were required. Thus, there is a long-felt need for a luminary wherein the heat generation from the light source is dissipated. There is a further long-felt need for an LED luminary wherein the heat is dissipated from the light source. There is also a long-felt need for a mechanism to dissipate the heat using a liquid source to move the heat from the LED luminary.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "luminary" is synonymous with terms such as "light", "LED", "pool light", "light fixture", "encapsulated light", etc., and such terms may be used interchangeably as appearing in the specification and claims. In addition, it should be appreciated that the term "tunnel" is synonymous with terms such as "pathway", "channel", "passageway", "strait", etc., and such terms may be used interchangeably as appearing in the specification and claims. Although any methods, devices or materials similar or equivalent to those described herein can be used in the practice or testing of the invention, the preferred methods, devices, and materials are now described.

Figure 1B:
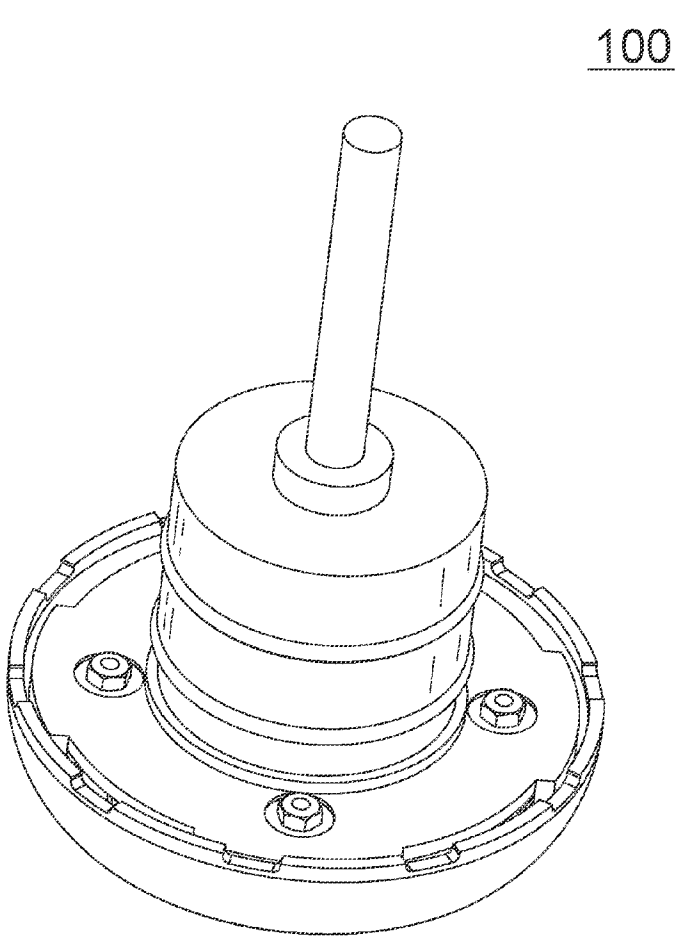
FIG. 1*b* is a lower perspective view of the present invention.
Figure 1A:
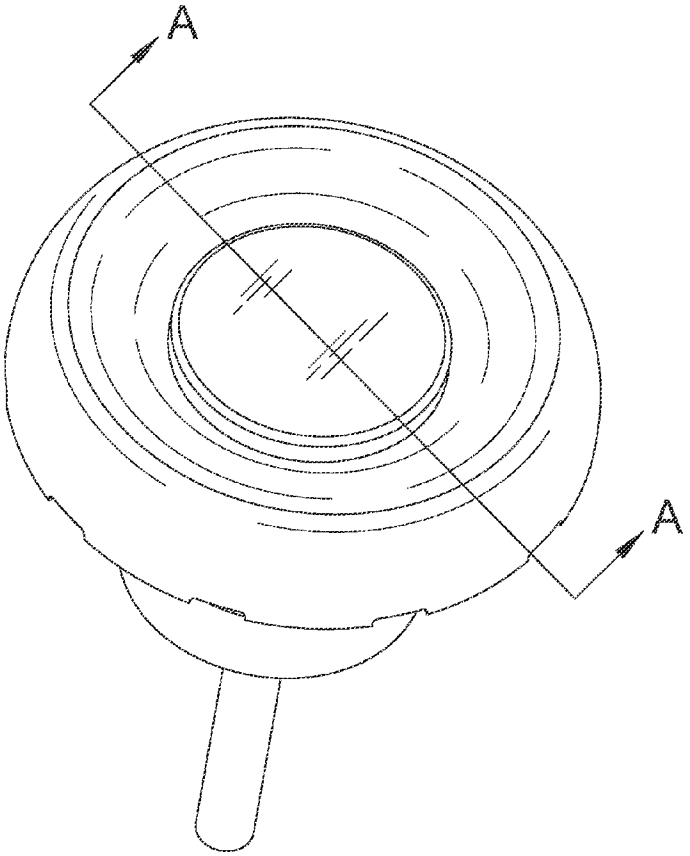
FIG. 1*a* is an upper perspective view of the present invention.
Figure 2:
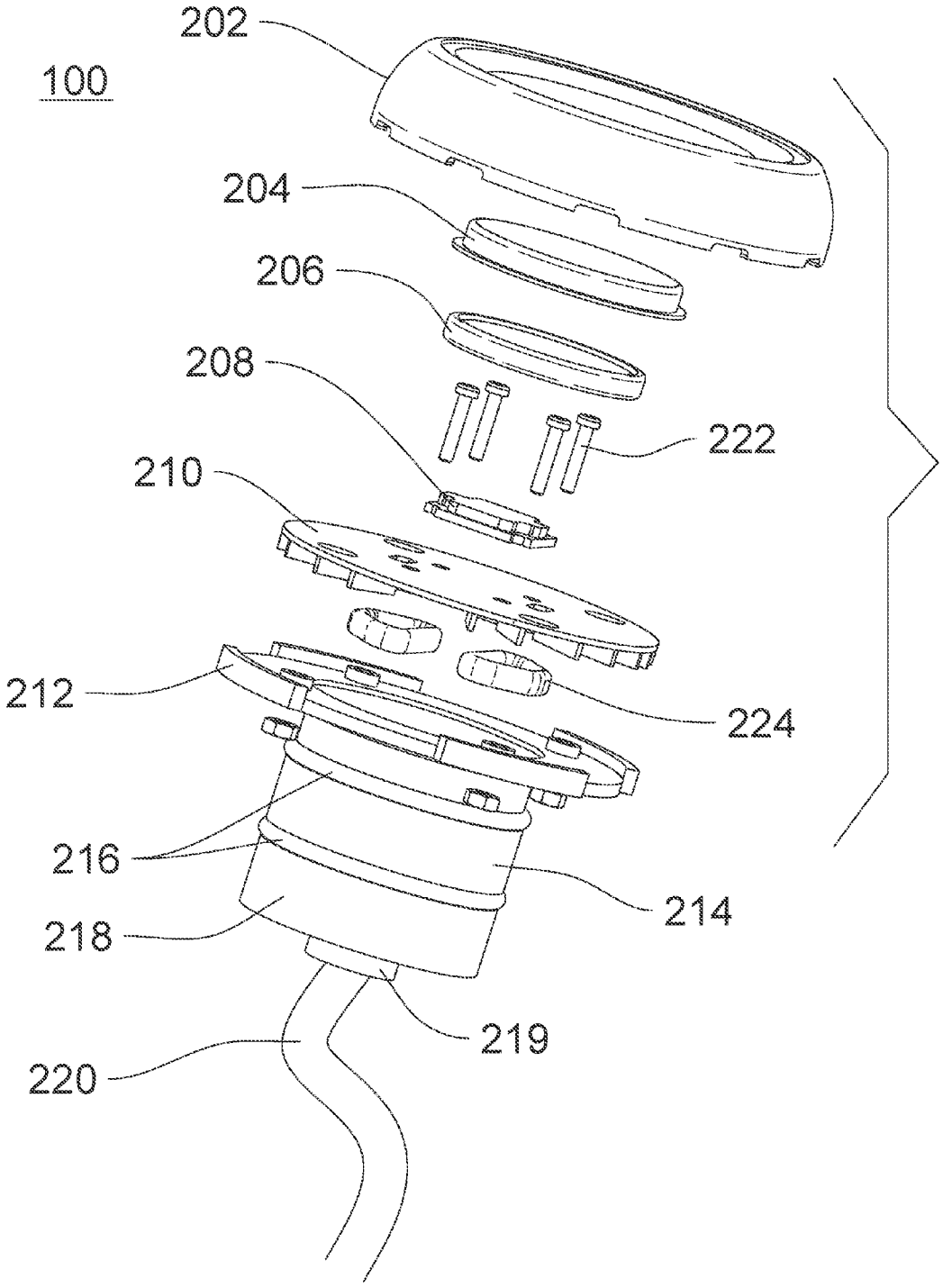
FIG. 2 is a side partially exploded perspective view of the present invention.

Adverting now to the figures, FIGS. 1*a* and 1*b* show an assembled submerged light fixture 100 from the top and bottom perspectives of the fixture. The instant invention provides a more efficient pool light fixture that includes an encapsulation system and cooling process. FIG. 2 is a partially exploded view of the components included in the submerged light fixture 100.

The encapsulation system of the submerged light fixture 100 includes a light enclosure, a sealing agent 226 (see FIG. 11), and an upper platform 210. The light enclosure includes a cover 202, lens 204, lens rings 206, and light assembly 208. FIG. 2 illustrates how the encapsulation system is assembled to seal the light assembly 208 from direct interaction with the outside environment, e.g. water in a pool. Sealing the electrical components of the instant invention eliminates the safety concern of water being electrified from the electrical components of the invention The light enclosure is formed when the light assembly 208 is secured to the top of the upper platform 210. The top of upper platform 210 is a planar surface with a series of openings, such as upper light fastener openings 702, upper cover bolt openings 704, and power supply openings 712 (see FIGS. 7*a* and 7*b*).

Figure 6A:
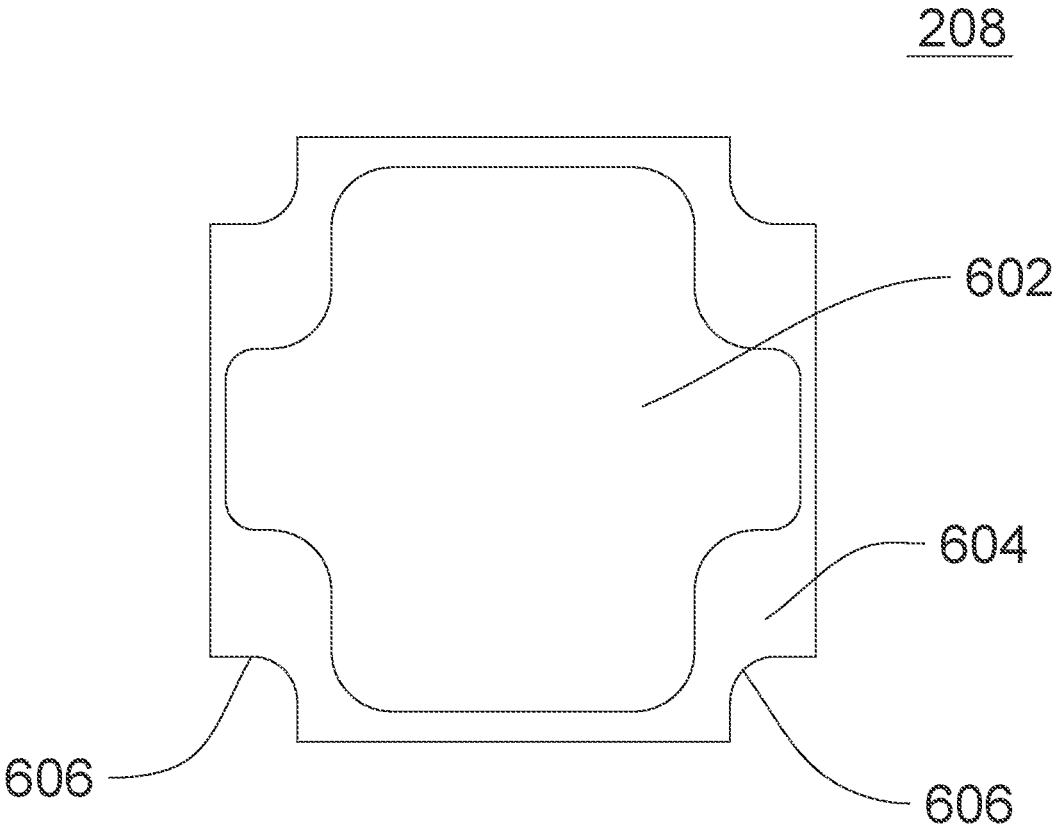
FIG. 6*a* is a top view of the light assembly of the present invention.
Figure 6B:
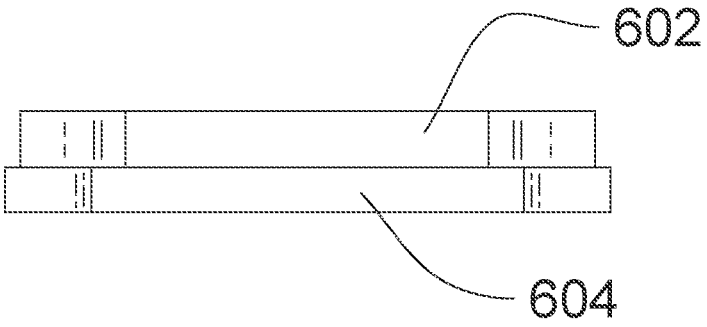
FIG. 6*b* is a side view of the light assembly of the present invention.

As shown in FIGS. 6*a* and 6*b*, the light assembly 208 includes a light source 602 connected to a light platform 604. A LED is used as the light source 602 in the instant invention. In exemplary embodiments, other known lights sources can be used in place of a LED light source, such as but not limited to organic light emitting diodes (OLED). Light platform 604 also includes light fastener mounts 606 as cutouts to as a location to fasten light assembly 208 to upper platform 210 (and lower platform 212).

Fasteners 222 secure the four corners of light platform 604, using the light fastener mounts 606, to the top of the upper platform 210. Upper platform 210, shown in FIGS. 7*a*, 7*b*, and 7*c*, includes upper light fastener openings 702. Fasteners 222 secure the light assembly 208 to the upper platform 210 through the upper light fastener openings 702. The instant invention uses screws as fasteners 222 but any known fastener can be used, such as but not limited to bolts and rivets. Removable fasteners are preferred in order to replace the light source 602 or light assembly 208 if necessary. Once light assembly 208 is secured to upper platform 210, the remaining components of the light enclosure are assembled.

The next step to assemble the light enclosure is to insert lens ring 206 within lens 204, the components depicted in FIGS. 4*a*, 4*b*, 5*a*, and 5*b*. Lens 204 includes an outer lens surface 402, inner lens surface 404, and lens connector footing 406. The lens ring 206 is positioned against the inner lens surface 404 and within the lens connector footing 406 which has a larger inner diameter than the lens ring 206.

Figure 3B:
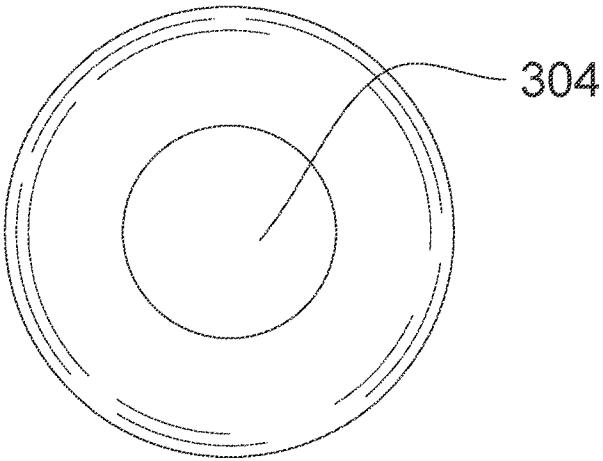
FIG. 3*b* is a top view of the cover of the present invention.
Figure 3D:
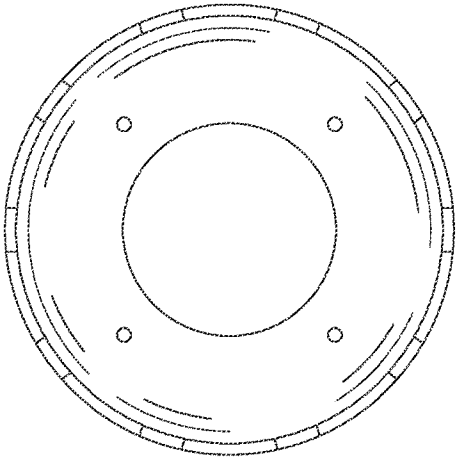
FIG. 3*d* is a bottom view of the cover of the present invention.

Once lens ring 206 is positioned within lens 204, the lens 204 is placed onto the cover upper opening 304 of cover 202 (see FIG. 3*b*). Then, a sealing agent 226 is deposited in the space defined by the inner lens surface 404 and the lens connector footing 406, which now includes lens ring 206. The cover 202, which includes lens 204, lens rings 206 and sealing agent 226, is positioned over the light assembly 208 that is secured to the top surface of the upper platform 210. Alternatively, the lens 204, lens ring 206, and sealing agent 226 can be placed on top of the light assembly 208 and then the cover 202 is positioned over the lens 204 and secured to upper platform 210 with fasteners 222.

Careful attention is required to verify that the sealing agent 226 fills the entire space between the lens 204 and planar top surface of upper platform 210. The sealing agent 226 is designed to fill all the space between the lens 204 and the upper platform 210 to fully encapsulate the light assembly 208 and eliminate the ability for water to penetrate into the light enclosure. In some instances, the sealing agent 226 overflows lens 204 when the light enclosure is secured. When the sealing agent 226 cures or dries, the light assembly 208 is sealed and protected from the pool water. The sealing agent 226 in the instant invention is a resin, preferably a neutral transparent silicone b-component resin. A transparent or partially transparent resin reduces the loss of light emitted from the LED.

Figure 11:
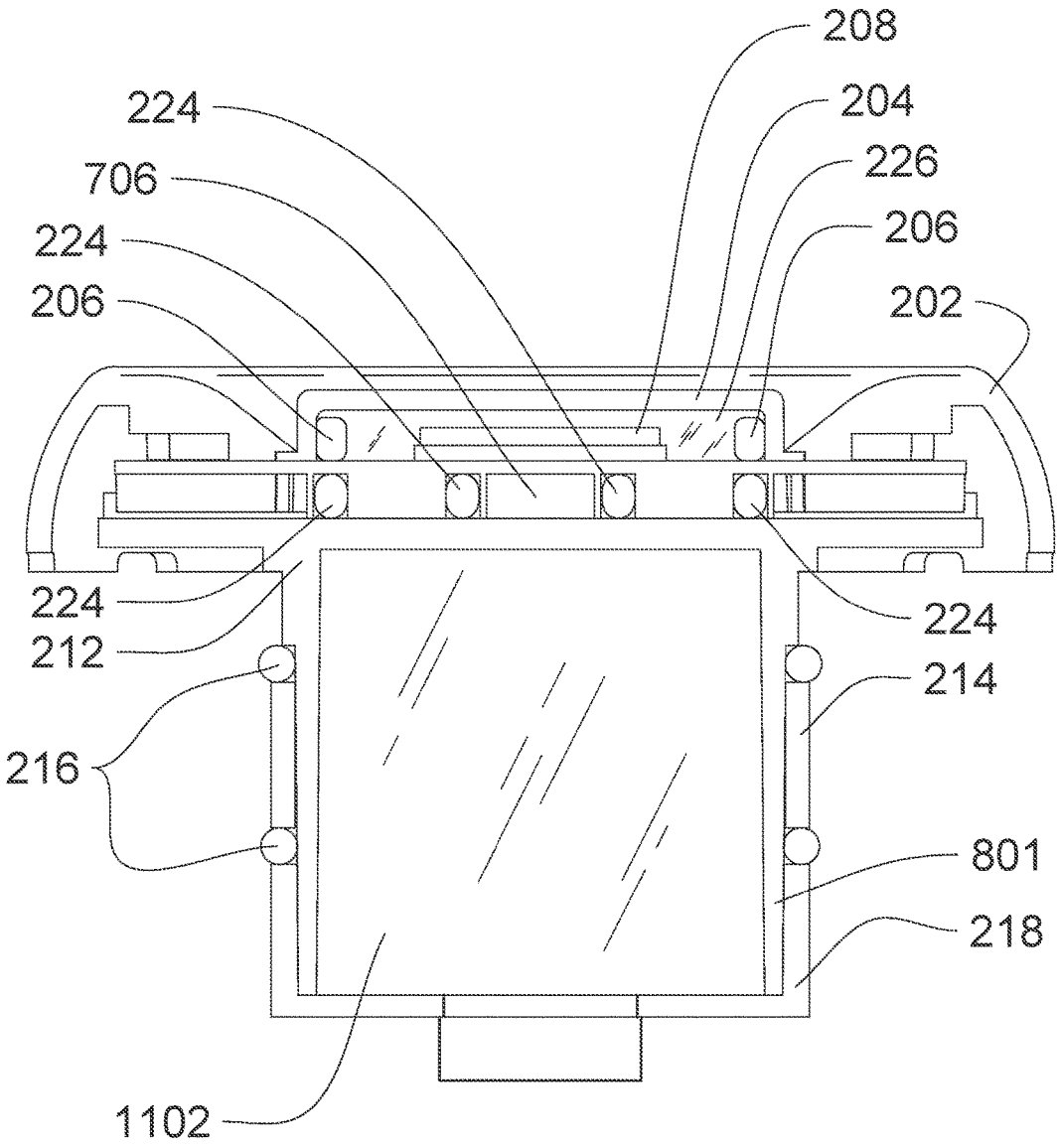
FIG. 11 is a cross sectional view of the present invention.

Another benefit of the sealant is that, once dry, the electrical components are permanently anchored in place. Even if a solder connection loosens, the wires remain in place due to the sealing agent 226. By encapsulating light assembly 208 using sealing agent 226, the light assembly 208 is capable of withstanding a higher water pressure since there will be no air in the chamber that sealing agent 226 fills, as illustrated in FIG. 11. This allows the present invention to be installed in higher pressure water depths, such as but not limited to deeper pools or research facilities that does testing in high pressure environments.

Lens 204 is an opaque material but may be fully or partially transparent depending on specific lighting requirements. Although exemplary embodiments of the instant invention use transparent lenses, an opaque material allows maximum light to pass through the lens as light is not lost through transmission from the LED light source 602 to the environment. Also, an opaque lens distributes light uniformly.

Figure 7B:
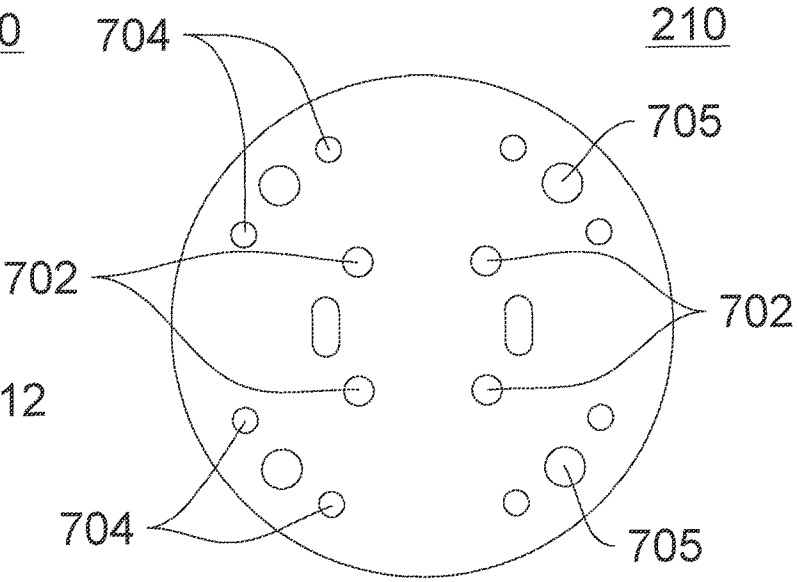
FIG. 7*b* is a top view of the upper platform of the present invention.
Figure 7A:
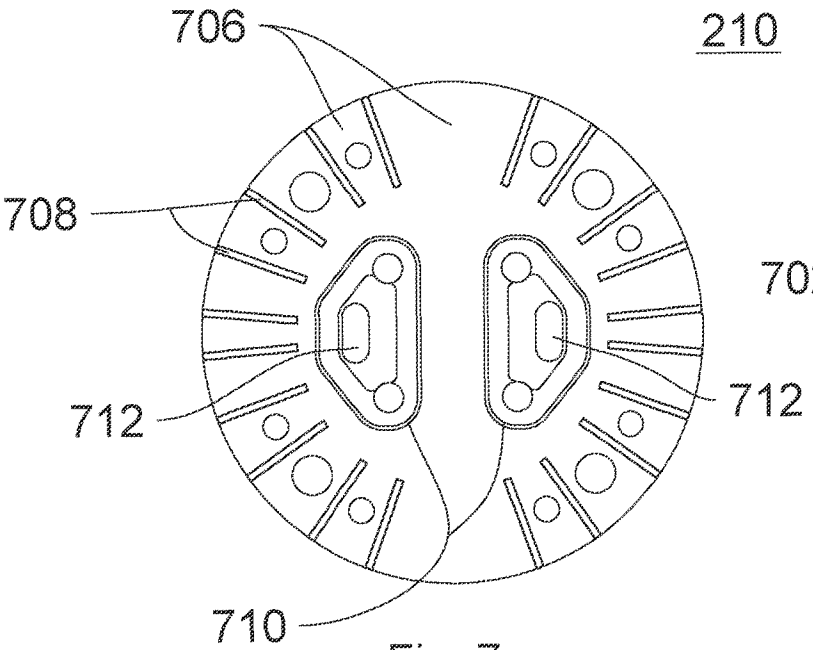
FIG. 7*a* is a bottom view of the upper platform of the present invention.

Upper platform 210 includes three sets of holes. As shown in FIGS. 7*a* and 7*b*, there are two sets of upper cover bolt openings 704 and one set of upper platform inlets 705. The four upper platform inlets 705 provide a pathway for water or any other fluid to flow through the upper platform 210. Radially clockwise from upper platform inlets 705 is a first set of four upper cover bolt openings 704. Radially counterclockwise from upper platform inlets 705 is an identical second set of four upper cover bolt openings 704. Upper cover bolt openings 704 are used to secure cover 202, along with lens 204, to the upper platform 210. Either set of upper cover bolt openings 704 can be used to secure cover 202. The unused upper cover bolt openings 704 aid in the flow of water through upper platform 210.

Cover 202 is depicted in FIGS. 3*a*, 3*b*, 3*c*, and 3*d*. Multiple cover slots 302 are located on the outside edge of the cover 202. When the invention is fully assembled, as shown in FIGS. 1*a* and 1*b*, the cover slots 302 align with the lower platform tunnel openings 806 (see FIGS. 8*a* and 8*b*) to provide a pathway for fluid flow in and out of the instant invention. Cover 202 also includes a cover upper opening 304, which is an opening in the middle of the cover 202. The diameter of cover upper opening 304 is designed to fit the diameter of the outer lens surface 402 to make sure the light enclosure is fully sealed from the pool water. In an exemplary embodiment, cover 202 is a plastic material.

Figure 3A:
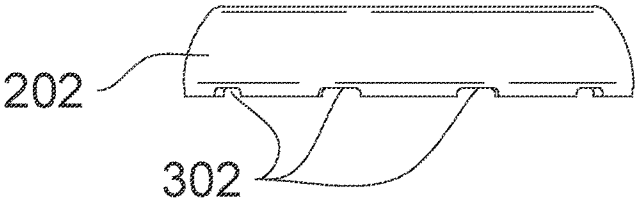
FIG. 3*a* is a side view of the cover of the present invention.
Figure 3C:
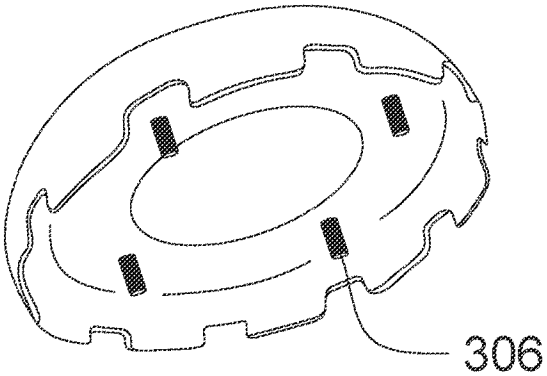
FIG. 3*c* is a lower perspective view of the cover of the present invention.
Figure 4A:
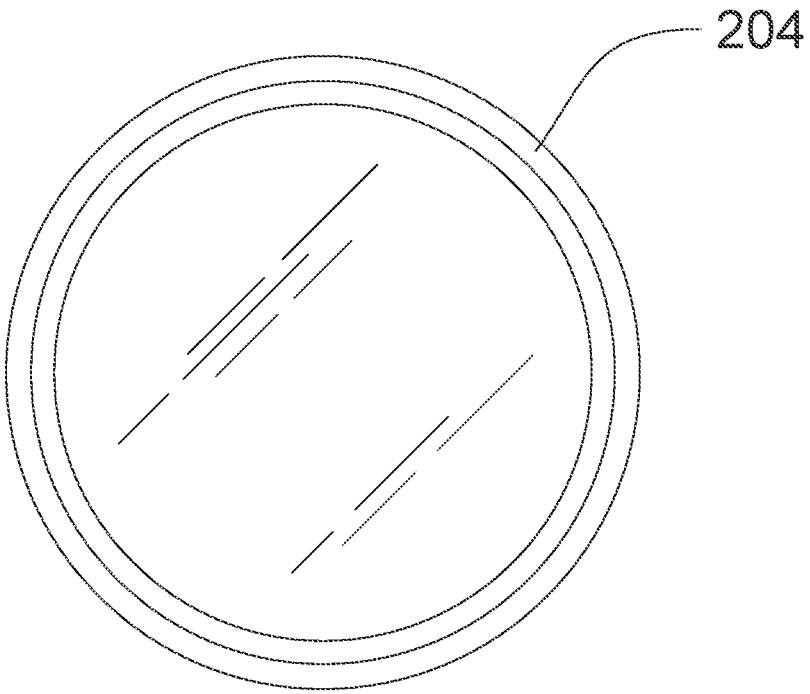
FIG. 4*a* is a top view of the lens of the present invention.
Figure 4B:
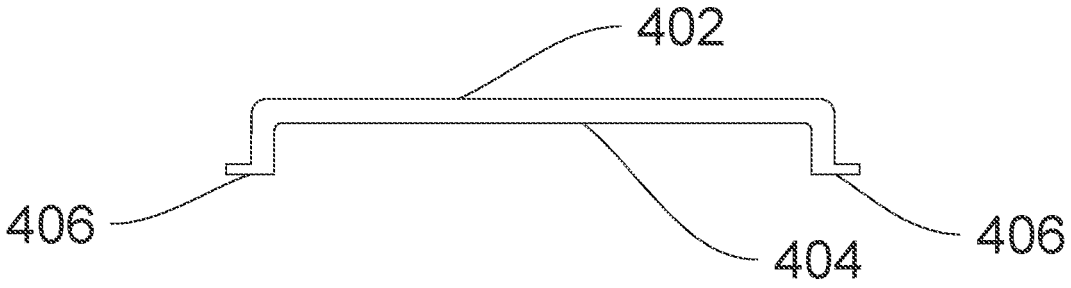
FIG. 4*b* is a side view of the lens of the present invention.
Figure 5A:
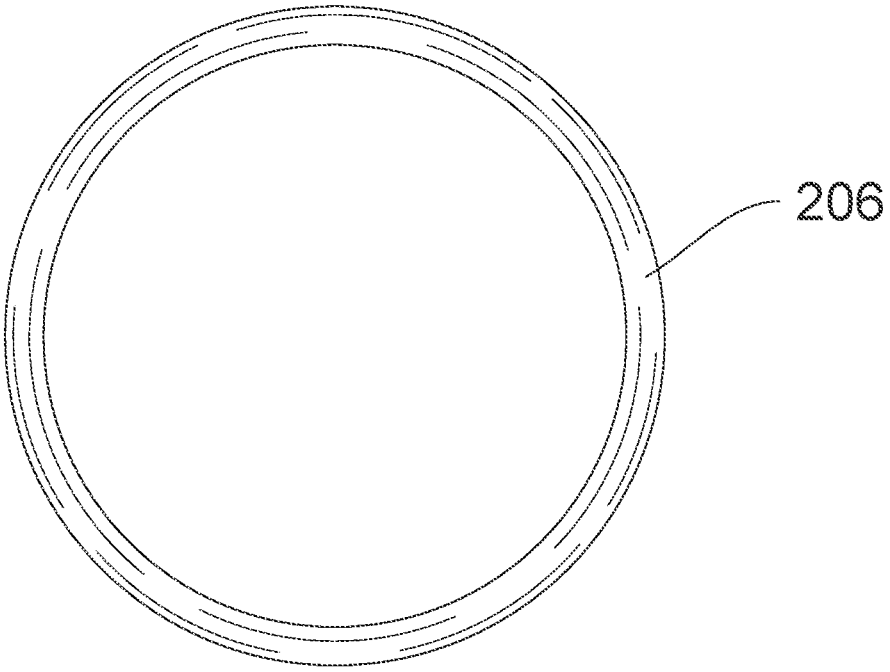
FIG. 5*a* is a top view of the lens ring of the present invention.
Figure 5B:
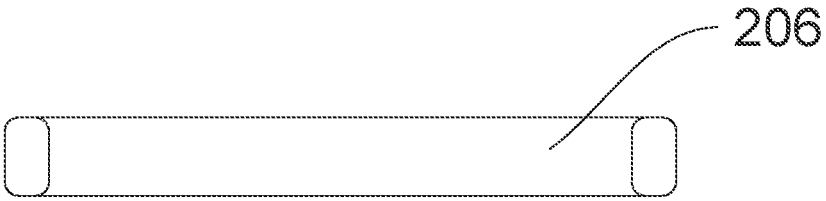
FIG. 5*b* is a side view of the lens ring of the present invention.

To secure the cover 202 and related light enclosure components to the upper platform 210 and lower platform 212, cover 202 includes cover bolts 306, as depicted in FIG. 3*c*. The cover bolts 306 are designed to secure the cover 202 to both upper platform 210 and lower platform 212 through upper cover bolt openings 704 and lower platform bolt openings 804. However, in an exemplary embodiment with only an encapsulated luminary, i.e. no internal fluid flow, the cover bolts 306 are designed to only secure the cover 202 and light enclosure to upper platform 210.

Figure 7C:
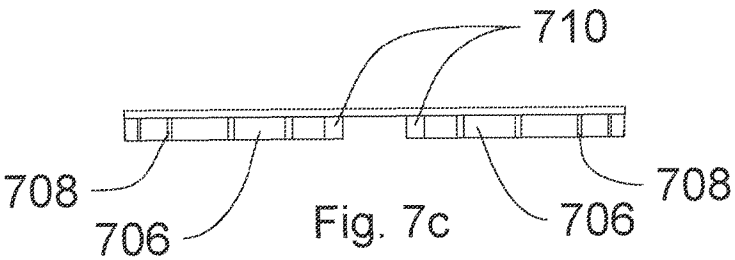
FIG. 7*c* is a side view of the upper platform of the present invention.

Progressing down the invention are upper platform 210 and lower platform 212. A multitude of fins 708, radially positioned that protrude from the bottom of upper platform 210, define tunnels 706 that allow water to pass through the upper platform 210 and lower platform 212, when assembled. As shown in FIGS. 2, 7*a*, and 7*c*, the radial position of fins 708 directs water inward of platforms 210, 212 through tunnels 706. The light assembly 208 is mounted on the top of upper platform 210 (see FIGS. 2 and 7*b*). The water flowing on the bottom of upper platform 210 is directed inward by the radially positioned fins 708 to the primary tunnel that passes underneath the light assembly 208 (see FIG. 7*a*). Specifically, water passes by the bottom of upper platform 210, directly underneath the mounted light source 602.

While fins 708 are positioned in a radial position, numerous alternative directional patterns can be used to aid in permitting water to flow through the submerged light fixture 100 to dissipate heat from the light source 602. In an exemplary embodiment, the fins 708 protrude from the lower platform 212. In yet another exemplary embodiment, the fins 708 are a separate insert placed between the upper platform 210 and lower platform 212. The use of multiple tunnels 706 increases the water flow and heat dissipation away from the light source 602. However, a single tunnel 706 is also effective depending on the amount of heat being dissipated from light source 602. As can be seen from the design of the submerged light fixture 100, the critical aspect is to provide water flow through the fixture in close proximity to the light source 602, with a buffer from the electrical components, to aid in heat dissipation.

The flow of water through platforms 210, 212 aids in dissipating heat generated by the light source 602. Although the instant invention is designed for use in a pool filled with water, any fluid can travel through the tunnels 706. Water does not make contact with any of the electrical components of the invention.

FIGS. 7*a*, 7*b*, and 7*c* illustrate upper platform 210. As previously described, cover 202, and light enclosure, is secured to upper platform 210 using fasteners 222 through upper light fastener openings 702. There are four upper light fastener openings 702 on upper platform 210. Adjacent to the upper light fastener openings 702 are two power supply openings 712 that provide a pathway for electrical wires to pass through upper platform 210 and connect to light source 602. Upper platform 210 also includes upper platform inlets 705 and upper cover bolt openings 704, as described herein.

The underneath surface of upper platform 210 includes additional features. FIG. 7*a* illustrates the fins 708 and tunnels 706 that route the water through the submerged light fixture 100. Upper platform inlets 705 and upper cover bolt openings 704 are located on upper platform 210 in-between the series of radially positioned fins 708. Upper platform ring supports 710 protrude outward from the underneath surface of upper platform 210. Each upper platform ring support 710 is D-shaped. A power supply opening 712 is located within each upper platform ring support 710. A disk ring 224 is placed within each upper platform ring support 710. When lower platform 212 is positioned underneath upper platform 210 and the instant invention is secured together using the cover bolts 306, disk rings 224 create a seal between the upper platforms 210 and lower platform 212 to keep the electrical lines running through the power supply openings 712 protected from water immersion.

In an exemplary embodiment, the upper platform 210 and lower platform 212 are termed a luminary core. The luminary core includes similar fins 708 that define tunnels 706 that pass through the luminary core directing water underneath the mounting location of light source 602. The luminary core may be two distinct components, upper platform 210 and lower platform 212, or a single unitary construction.

In yet another exemplary embodiment, the light enclosure is supported by the outer surface of the upper platform 210 and at least one tunnel 706 passes underneath the light source 602.

The instant invention uses plastic as the material of upper platform 210. In an example embodiment, the plastic contains additives to make the plastic thermally conductive. Upper platform 210 is optimally a non-electrical conductive polymer that contains a thermal conductive additive to aid in heat dissipation from light assembly 208. The upper platform 210 is not electrically conductive for safety and security concerns. The instant invention is electrically insulated from the surrounding water.

Figure 8A:
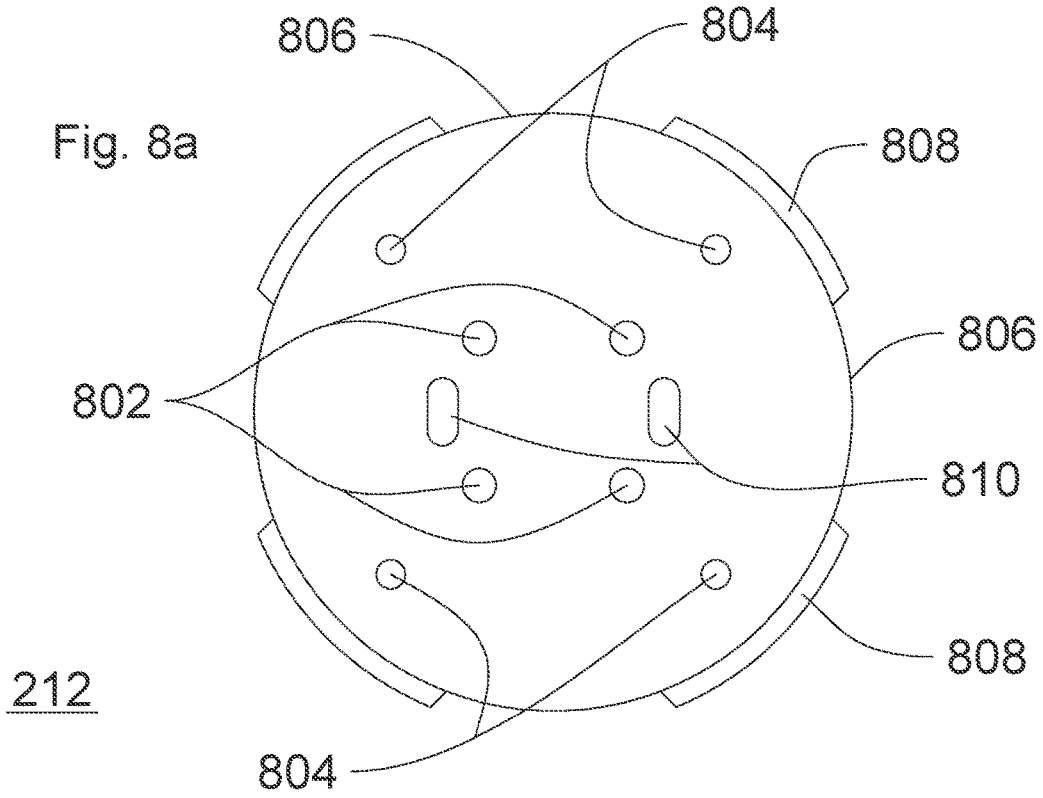
FIG. 8*a* is a top view of the lower platform of the present invention.
Figure 8B:
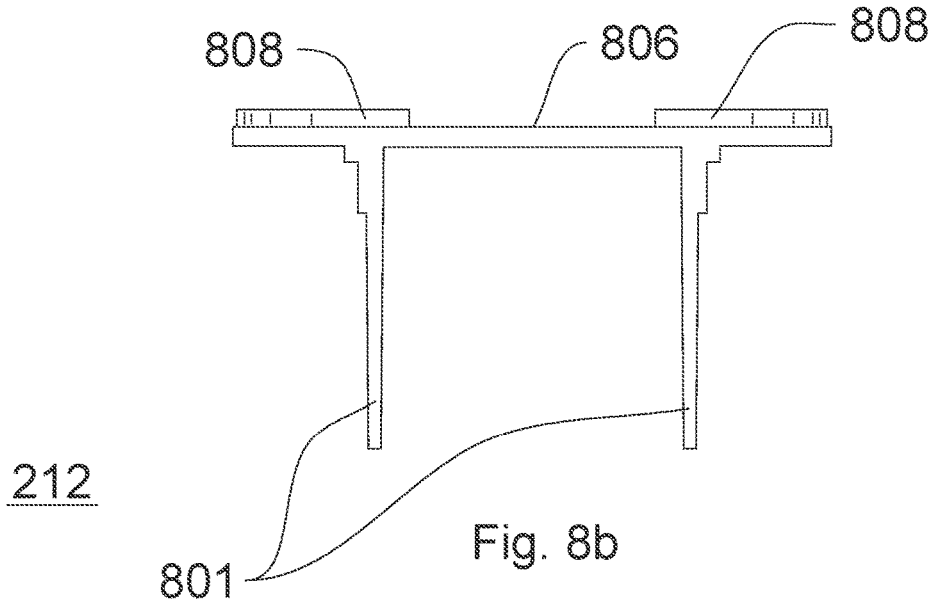
FIG. 8*b* is a side view of the lower platform of the present invention.

FIGS. 8*a* and 8*b* illustrate the features of lower platform 212, which is aligned with upper platform 210. The top portion of lower platform 212 includes lower light faster openings 802, which align with upper light fastener openings 702. Fasteners 222 secure light assembly 208 through the upper light fasteners openings 702 and lower light fastener openings 802.

The cover 202 is secured to upper platform 210 and lower platform 212 using cover bolts 306 through upper cover bolt openings 704 and lower platform bolt openings 804. In an exemplary embodiment that does not contain the lower platform 212, cover 202 is secured to only upper platform 210 using cover bolts 306 and light assembly 208 is secured through upper light fastener openings 702. When assembled, lower power supply openings 810 are aligned with the upper power supply openings 712 of upper platform 210 to provide a pathway for the electrical connection to power light source 602.

Lower platform 212 includes ribs 808 to aid in routing water through the upper platform 210 and lower platform 212 and under the light source 606. The water passes into the instant invention into the tunnels 706 of upper platform 210 through the lower platform tunnel openings 806.

Lower platform 212 also includes lower platform body 801. When assembled, the area inside the lower platform body 801 is filled with lower sealing agent 1102, illustrated in FIG. 11. While sealing agent 226 is preferably a transparent material, lower sealing agent 1102 can be an opaque material since light is not transferring through lower sealing agent 1102. Lower platform 801 includes a series of steps from the planar top portion of lower platform 212 (See FIG. 8*b*).

Figure 9:
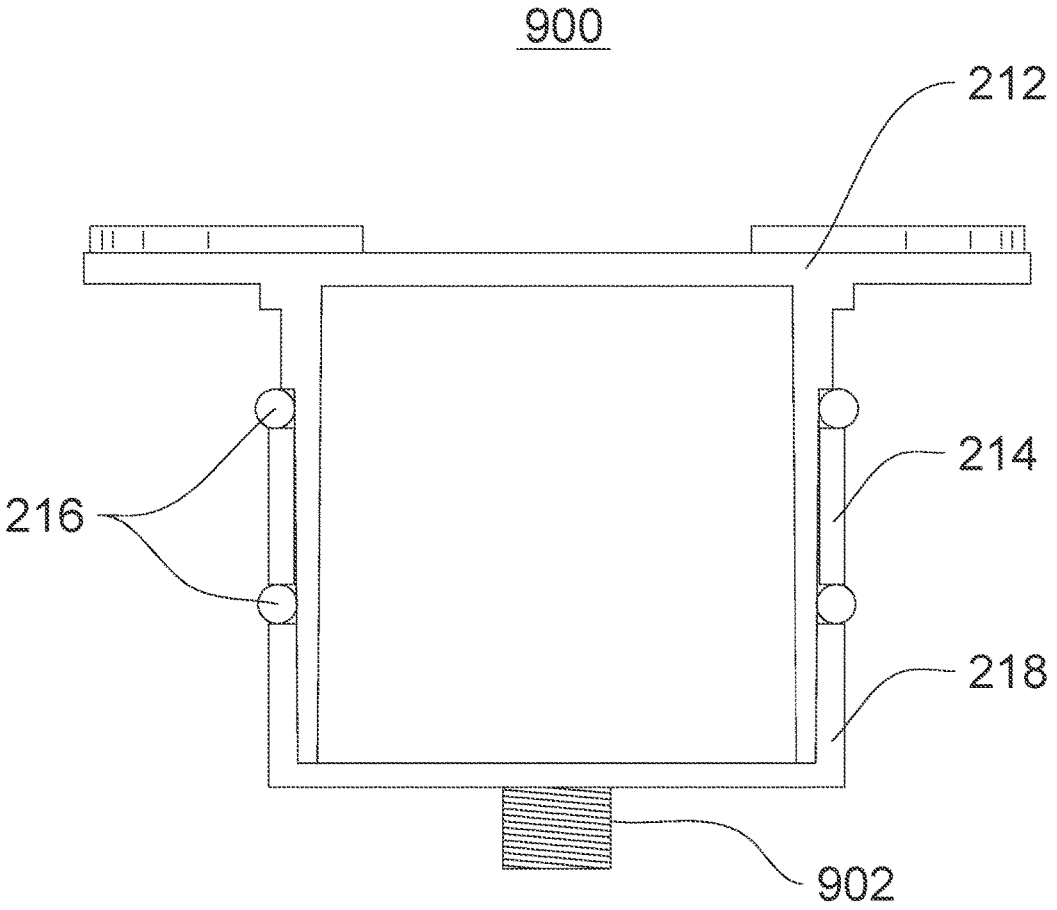
FIG. 9 is a side view of the lower assembly of present invention.

The lower assembly 900 is best illustrated in FIG. 9. A first core ring 216 is placed on the exterior of lower platform body 801 next to a step. Next, core spacer 214 is placed over the exterior of lower platform body 801, adjacent to the first core ring 216. A second core ring 216 is then placed adjacent to the core spacer 214. Lastly, core cap 218 is placed onto the bottom portion of lower platform body 801, adjacent to the second core ring 216. Core connector 902 is located on the bottom of core cap 218 to provide a pathway for the electrical wiring running through the instant invention. The use of core rings 216 ensure a water tight seal for the lower assembly 900.

Figure 10A:
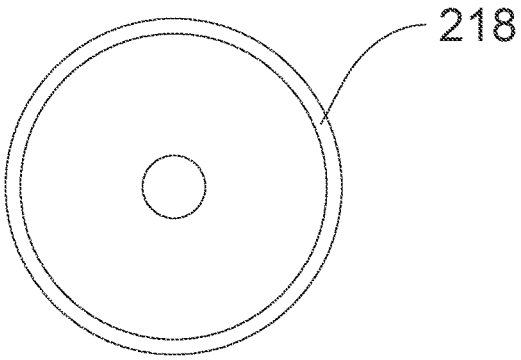
FIG. 10*a* is a top view of the core cap of the present invention.
Figure 10B:
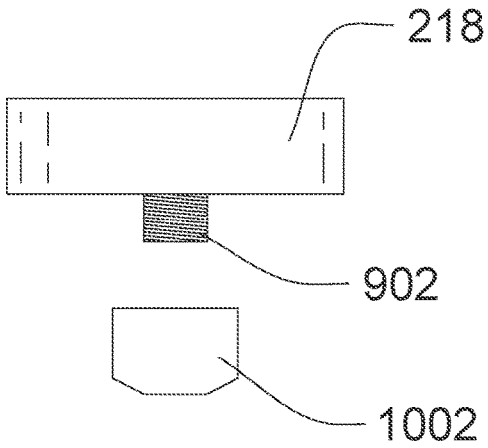
FIG. 10*b* is a side view of the core cap of the present invention using a connector cap.
Figure 10C:
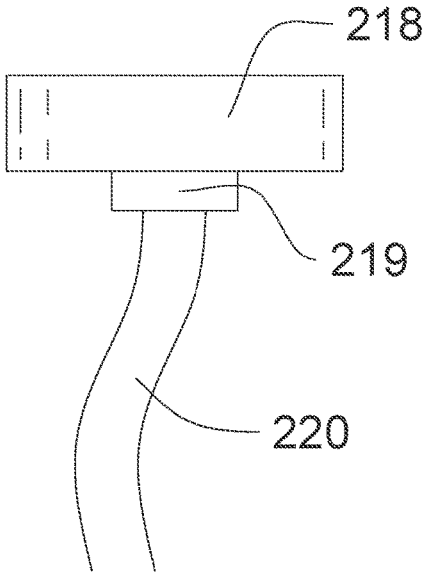
FIG. 10*c* is a side view of the core cap of the present invention using an electrical cable.

The electrical connection enters the instant invention through core cap 218. As shown in FIGS. 10*a* and 10*b*, the instant invention includes a core connector 902, e.g. a threaded connector. Connector cap 1002, shown in FIG. 10*b*, is screwed onto core connector 902 to close the instant invention during transport and prior to placement in a pool wall. In an exemplary embodiment, a cord connector 219 is threaded onto core connector 902, instead of connector cap 1002, when an electrical cable 220 is routed and installed into the instant invention.

FIG. 11 is a cross sectional view of section A from FIG. 1*a*. This cut away view shows the stack up of the various components. FIG. 11 is the optimal way to show how sealing agent 226 and lower sealing agent 1102 fill certain areas of the instant invention. It also provides another viewing perspective to better illustrate how the components are placed relative to one another.

Two sets of fasteners are used in the instant invention, fasteners 222 and cover bolts 306. While screws and bolts are preferred options for fasteners 222 and cover bolts 306, a wide array of connection fasteners known in the industry can be used to secure the various components of the instant invention together.

Another aspect of the instant invention is the method of cooling the submerged light fixture 100. The submerged light fixture 100 is submerged in water or another fluid. The light fixture is either partially submerged in water or fully submerged in water. In either case, water flows through the tunnels 706 of the submerged light fixture 100 defined by the radially positioned fins 708 between the upper platform 210 and lower platform 212.

The submerged light fixture 100 is installed into a wall of a pool. The submerged light fixture 100 is typically installed into a side wall of a pool or the bottom of a pool. The submerged light fixture 100 is positioned in the pool wall that contains the water in such a manner that the cover 202 is located on the outside of the pool wall. As shown in FIGS. 3*a* and 11, cover slots 302 allow water to flow in and out of the submerged light fixture 100 because cover 202 sits flush with the pool wall surface. Since the submerged light fixture 100 is submerged fully or partially under water, water is continuously being moved through tunnels 706 to dissipate heat from the light source 602. This makes the light source 602 more efficient, increases the lifespan of the light source 602, and reduces the frequency of replacing the submerged light fixture 100.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A submerged light fixture, comprising:
- a light enclosure comprised of a cover and a continuous lens;
- a light source secured to an upper platform;
- the light enclosure secured to the upper platform, wherein a sealing agent fills the space between the light enclosure and the upper platform containing the light source;
- a lower platform; and
- a plurality of fins between the upper platform and lower platform defining at least one tunnel passing underneath the light source that provides a pathway for a medium to be in fluid communication with the submerged light fixture and an external source.

2. The submerged light fixture recited in claim 1, wherein the light source is a light emitting diode.

3. The submerged light fixture recited in claim 2, wherein the continuous lens is solid without any openings.

4. The submerged light fixture recited in claim 1, wherein:
- the light enclosure is formed when:
  - a lens ring is positioned within the lens;
  - the lens is positioned over the light source on the upper platform;
  - the cover is placed over the lens; and
  - the cover is secured to the upper platform.

5. The submerged light fixture recited in claim 4, wherein the sealing agent is silicone.

6. The submerged light fixture recited in claim 1, wherein the fins are positioned radially between the upper platform and the lower platform.

7. The submerged light fixture recited in claim 1, further comprising at least one cover slot on the cover.

8. The submerged light fixture recited in claim 7, wherein:
- the cover slots are located on the outside edge of the cover; and
- at least one tunnel is in fluid communication with at least one cover slot.

9. A submerged light fixture, comprising:
- a light enclosure comprised of a cover and continuous lens, wherein the cover includes at least one cover slot;
- a luminary core comprised of an upper platform and a lower platform, wherein fins define at least one tunnel between the upper platform and the lower platform;
- the light enclosure is secured to the upper platform through the cover, wherein a light source is secured to the upper platform and within the light enclosure; and
- a liquid from a pool flows through the at least one cover slot and into at least one tunnel located behind the light source.

10. The submerged light fixture recited in claim 9, wherein the fins are positioned radially between the upper platform and the lower platform.

11. A method of cooling a submerged light fixture, comprising:
- filling a light enclosure mounted on an upper platform with a sealing agent, wherein a light source mounted on the upper platform is incased in the sealing agent;
- installing the light fixture on a pool wall;
- filling the pool with a liquid, wherein the light fixture becomes submerged in the liquid;
- flowing the liquid through the light fixture, wherein:
  - liquid flows through cover slots of the light enclosure into at least one tunnel defined by fins between an upper platform and a lower platform;
  - at least one tunnel passes directly underneath a light source mounted to the upper platform; and
  - the liquid is in fluid communication with the at least one tunnel and a pool.

12. The method of cooling a submerged light fixture in claim 11, further comprising installing the light fixture in the wall of a pool wherein a cover of a light enclosure of the light fixture is positioned on the outer surface of the wall.

13. The method of cooling a submerged light fixture in claim 11, wherein the light enclosure comprises:

a lens ring positioned within a lens;

the lens is positioned over the light source on the upper platform;

a cover is placed over the lens; and the cover is secured to the upper platform.

14. The submerged light fixture recited in claim 4, wherein the sealing agent is a resin.

15. The submerged light fixture recited in claim 1, further comprising:

powering the light source by routing electrical cable through:

a core cap;

a lower assembly;

at least one lower power supply opening in the lower platform; and at least one power supply opening in the upper platform; and connecting the electrical cable to the light source.

16. The submerged light fixture recited in claim 15, further comprising:

pool water as the medium;

at least one disk ring housed within at least one upper platform ring support; and the at least one disk ring support sealing the electrical cable between the upper platform and the lower platform from the pool water.

17. The submerged light fixture recited in claim 9, further comprising:

a liquid sealing agent that incases the light source by filling the space between the light enclosure and upper platform; and the liquid sealing agent curing into a solid material.

18. The method of cooling a submerged light fixture in claim 11, wherein the light source is a light emitting diode.

19. The method of cooling a submerged light fixture in claim 11, wherein the sealing agent is silicone.

* * * * *